United States Patent [19]

Kyushima

[11] Patent Number: 4,825,118

[45] Date of Patent: Apr. 25, 1989

[54] ELECTRON MULTIPLIER DEVICE

[75] Inventor: Hiroyuki Kyushima, Hamamatsu, Japan

[73] Assignee: Hamamatsu Photonics Kabushiki Kaisha, Hamamatsu, Japan

[21] Appl. No.: 903,306

[22] Filed: Sep. 3, 1986

[30] Foreign Application Priority Data

Sep. 6, 1985 [JP] Japan ..... 60-197371
Feb. 21, 1986 [JP] Japan ..... 61-37670

[51] Int. Cl.[4] ..... H01J 43/00

[52] U.S. Cl. ..... 313/104; 313/103 R; 313/103 CM

[58] Field of Search ..... 313/103 R, 103 CM, 104, 313/105 R, 105 CM, 528, 533, 534, 535, 536; 250/207; 328/243

[56] References Cited

U.S. PATENT DOCUMENTS 2,821,637 1/1958 Roberts et al. ..... 313/528
3,879,626 4/1975 Washington et al. ..... 313/534
4,691,099 9/1987 Johnson ..... 313/105 CM

*Primary Examiner*—David K. Moore
*Assistant Examiner*—T. Salindong
*Attorney, Agent, or Firm*—Spencer & Frank

[57] ABSTRACT

An electron multiplier device consists of an insulating substrate having, a plurality of through-holes, a first secondary electron emission layer and a second secondary electron emission layer or a conductive layer, and a DC electric field is applied to the first secondary electron emission layer with respect to the second latter secondary electron emission layer or conductive layer.

11 Claims, 7 Drawing Sheets

ELECTRON MULTIPLIER DEVICE

BACKGROUND OF THE INVENTION

The present invention relates to an electron multiplier device which can emit secondary electrons, and more particularly to such a device which can be used for a photomultiplier tube.

A prior electron multiplier device is known in which conventional dinodes of the Venetian-blind type are used and in which electrons are multiplied by a plurality of such dinodes which are closely arranged within a relatively narrow space.

FIG. 1 shows a cross-sectional view of a part of the electron multiplier device consisting of dinodes of the conventional venetian-blind type.

In FIG. 1, stages "i" and "i+1" of the electron multiplier device consisting of a plurality of mesh-and-dinode stages which are stacked are after another are shown in detail. Mi in FIG. 1 indicates the i-th mesh arranged orthogonally to the electron path. Dyi indicates the i-th dinode. Mi+1 indicates the "i+1"-th mesh. Dyi +1 --; and indicates the "i+1"-dinode.

The "i+1"-th dinode is inclined in the opposite direction to the i-th dinode.

Dinodes with opposite inclination angles and the corresponding meshes are alternately arranged to form an electron multiplier device.

The meshes are made of metal plates. Each metal plate is masked and selectively etched by a photoetching process.

The dinode of Venetian-blind type is made by press work, and this type of dinode is used as a secondary electron emission electrode.

Mesh Mi is connected to dinode Dyi and they are kept at potential Vi. Mesh Mi+1 is connected to dinode Dyi+1 and they are kept at potential Vi+1.

Secondary electrons emitted from dinode Dyi responding to the electrons incident on dinode Dyi are incident on inclined dinode Dyi+1 in the next stage, and then they are multiplied there.

If the number of dinodes in the electron multiplier device consisting of a plurality of dinodes of Venetian-blind type is increased, resolution at an arbitrary point on the incident plane can be improved to some extent.

Secondary electrons emitted from dinode Dyi are once decelerated by the rear surface of the adjacent dinode leaf and accelerated by mesh Mi+1--; in the next stage. Secondary electrons are then incident on dinode Dyi+1. Deceleration in the above process causes the electron transit time to be increased and its variation to be enhanced.

The electron transit time and its variation are proportional to the dimensions of the electrodes. The dinode sizes and the gaps between adjacent dinode leaves are to be minimized to reduce the electron transit time and its variation.

However, the accuracy of the dimensions in the dinodes finished by metal work is limited. It is thus impossible for the electron transit time and its variation to be reduced beyond the limit, and also for resolution at an arbitrary point on the dinode to be greatly improved.

The objective of the present invention is to present an electron multiplier device wherein the above problems can be solved.

SUMMARY OF THE INVENTION

An electron multiplier device of first type in accordance with the invention consists of a substrate of insulating material with first and second surfaces which are parallel with each other, a plurality of through-holes formed on the substrate having first through-hole surfaces at an obtuse angle with respect to the first surface of the substrate and second through-hole surfaces against the first through-hole surfaces, a secondary electron emission layer formed on the first surface of the substrate by depositing active materials onto the first surface of the substrate, a conductive layer formed on the second surface of each through-hole which is separated from the secondary electron emission layer, first connection means to connect the secondary electron emission layer to the respective power supply through the first surface of the substrate, second connection means to connect the conductive layer to the respective power through the second surface of the substrate the means to multiply the electrons incident on the through-holes passing through the first surface of the substrate by using the secondary electron emission layer, and to apply a pair of DC voltages to the first and second connection means so that the multiplied electrons are accelerated toward the second surface of the substrate.

An electron multiplier device of a second type in accordance with the invention consists of a substrate of insulating material with first and second surfaces which are parallel with each other, a plurality of through-holes formed on the substrate having first through-hole surfaces at an obtuse angle with respect to the first surface of the substrate and second through-hole surfaces against the first through-hole surfaces, a first secondary electron emission layer formed on the first surface of each through-hole, a second secondary electron emission layer formed on the second surface of each through-hole which is separated from the first secondary electron emission layer, first connection means to connect the first secondary electron emission layer to the respective power supply through the first surface of the substrate, second connection means to connect the second secondary electron emission layer to the respective power supply through the second surface of the substrate, and means to multiply the electrons incident on the through-holes passing through the first surface of the substrate by using the secondary electron emission layer, and to apply a pair of DC voltages to the first and second connection means so that the multiplied electrons are accelerated toward the second surface of the substrate.

DESCRIPTION OF THE PREFERRED EMBODIMENTS

The first type of electron multiplier device according to the invention will be described hereinafter referring to FIGS. 2 through 11.

Figure 1:
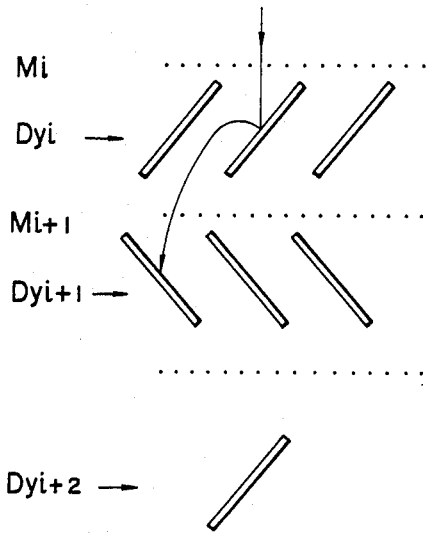
FIG. 1 (PRIOR ART)
FIG. 1 shows a cross-sectional view of the dinode arrangement of the conventional Ventian-blind type.
Figure 2:
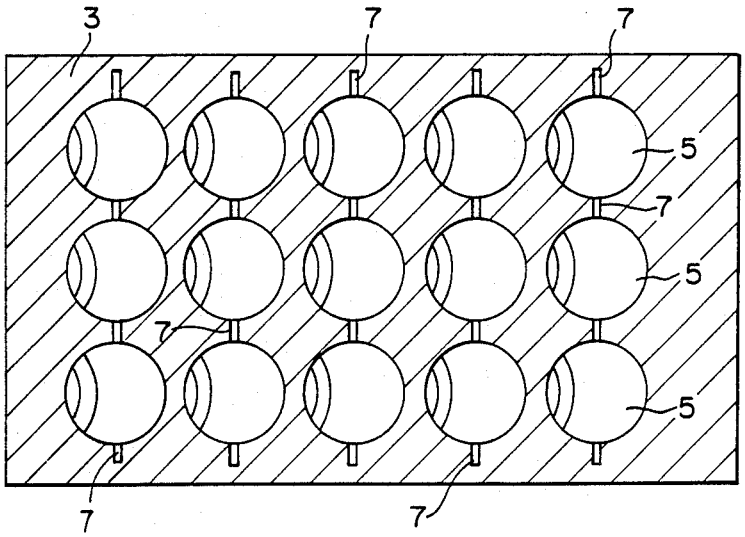
FIG. 2 shows a plan view of the first embodiment of the first type of the electron multiplier device in accordance with the present invention using one electron multiplier element.
Figure 3:
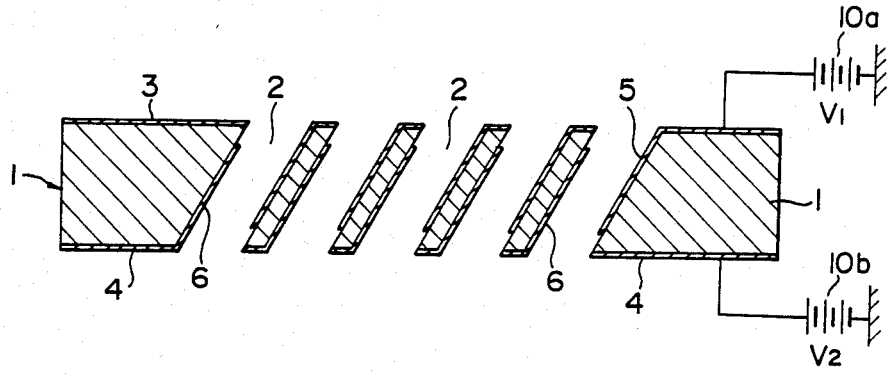
FIG. 3 is a cross-sectional view of the first embodiment shown in FIG. 2.
Figure 4:
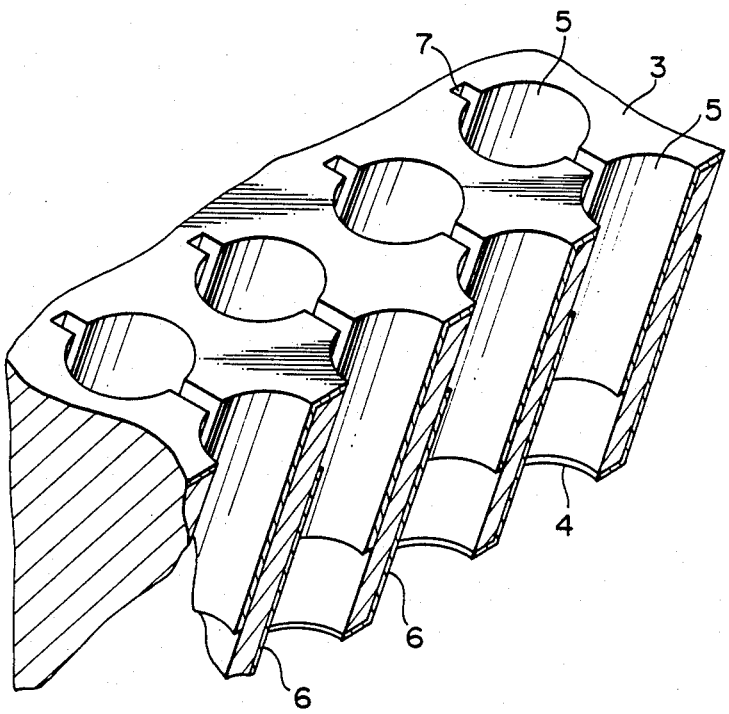
FIG. 4 is a perspective view of a part of the first embodiment shown in FIG. 3.

FIG. 2 is a plan view of the first embodiment of the first type of the electron multiplier device built in accordance with the present invention using one electron multiplier element. FIG. 3 is a cross-sectional view of the first embodiment of the present invention shown in FIG. 2 when the first embodiment of the electron multiplier device is operated. FIG. 4 is a perspective view of a part of the first embodiment shown in FIG. 3.

A plurality of through-holes 2 circular apertures are bored on planar insulating substrate 1 made of glass ($SiO_2$), and these are inclined to the incident plane of the electron beam.

Through-holes 2 are bored by a photoetching process.

When insulating substrate 1 is exposed to UV rays at the desired angle of the inclination of the through-holes through a negative image mask whereon a pattern consisting of the apertures and separation grooves are formed, a latent image is formed on the glass plate constituting insulating substrate 1 corresponding to the pattern of through-holes.

Thereafter, specific portions defined by the latent image are crystalized by heat treatment. Crystalized portions are selectively etched by acid to obtain a pattern of through-holes corresponding to the latent image pattern.

Antimony (Sb) is evaporated onto a first inclined plane of each through-hole which is at an obtuse angle with respect to RN upper surface of the substrate 1 whereon through-holes 2 are bored, and then secondary electron emission layer 5 is formed on this inclined plane.

Secondary electron emission layer 5 is insulated from the lower surface of substrate 1 so that the secondary electron emission layer cannot extend to the aperture in the other side of each through-hole.

An inactive conductive material such as aluminum (Al) is then evaporated onto a second inclined plane of each through-hole, which is at an obtuse angle with respect to the lower surface of the substrate 1 whereon through-holes 2 are bored, and is separated from the secondary electron emission layer by separation groove 7. Then, acceleration electrode layer 6 is formed onto this inclined plane by aluminum evaporation.

The acceleration electrode layer 6 is insulated from the upper surface of substrate 1 so that the acceleration electrode layer 6 cannot extend to the aperture in this side of the through-hole.

Connection means 3 to connect a plurality of secondary electron emission layers 5 to the respective power supply are formed on the first (upper) surface of insulating substrate 1 and connection means 4 to connect a plurality of accelerating electrode layers 6 to the respective power supplies are formed on the second (lower) surface of insulating substrate 1.

The function of the electron multiplier device built in accordance with the present invention will mainly be described referring to FIG. 3.

The electron multiplier device built in accordance with the present invention is arranged within a vacuum envelope. Connection means 3 and 4 are connected to power supplies 10*a* and 10*b*, respectively. DC voltage $V_2$ fed from power supply 10*b* is greater than De voltage $V_1$ fed from power supply 10*a*.

The potential difference between $V_1$ and $V_2$ causes an acceleration field toward acceleration electrode layer 6 starting from secondary electron emission layer 5.

Secondary electrons emitted from the first surface in the electron multiplier device is incident on secondary electron emission layer 5.

A single leaf of dinode in the electron multiplier device is not always used but a plurality of leaves of dinodes in the electron multiplier device are always used.

Figure 5:
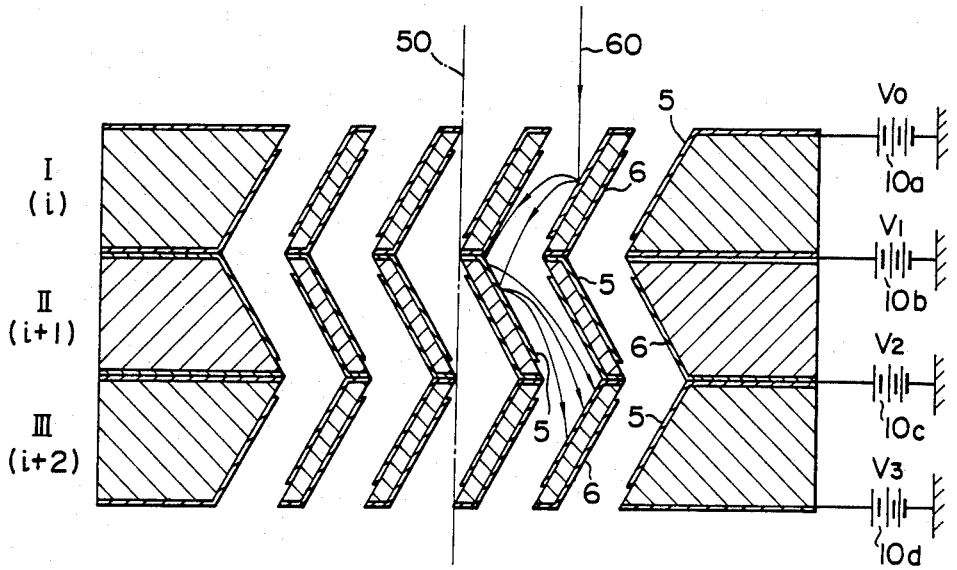
FIG. 5 is a cross-sectional view of an embodiment of the first type of the electron multiplier device consisting of three electron multiplier elements.

FIG. 5 is a cross-sectional view of an embodiment of the first type of the electron multiplier device consisting of three electron multiplier element.

The first leaf in the electron multiplier device is fastened to the second leaf in the electron multiplier device so that the through-holes in the second leaf are inclined in the opposite direction to the through-holes in the first leaf.

The second leaf in the electron multiplier device is fastened to the third leaf in the electron multiplier device so that the through-holes in the third leaf are inclined in the opposite direction to the through-holes in the second leaf and in the same direction as the through-holes on the first leaf. Power supplies 10*a* through 10*d*

($V_3 > V_2 > V_1 > Vo$) are connected to the respective terminals of the electron multiplier device.

Acceleration electrode layer 6 of the first leaf in the electron multiplier device and secondary electron emission layer 5 of the second leaf in the electron multiplier device are held at the same potential ($V_1$). Acceleration electrode layer 6 of the first leaf in the electron multiplier device is used to accelerate electrons multiplied by using secondary electron emission layer 5 of the first leaf in the electron multiplier device and to feed them to the secondary electron multiplication layers of the second leaf in the electron multiplier device.

This mode of operation is the same as the operation of the dinode of Venetian-blind type with which an acceleration mesh electrode held at the same potential as the dinode is provided.

Acceleration electrode layer 6 of the second leaf in the electron multiplier device and secondary electron emission layer 5 of the third leaf in the electron multiplier device are held at the same potential ($V_2$).

Electrons (60) incident onto electron emission layer 5 of the first leaf in the electron multiplier device are multiplied by electron emission layer 5. Thereafter, these electrons are incident on electron emission layer 5 of the second leaf in the electron multiplier device, and then multiplied there. Electrons multiplied by electron emission layer 5 of the second leaf in the electron multiplier device are multiplied by electron emission layer 5 of the third leaf in the electron multiplier device.

Electrons are thus multiplied by the second and third leaves in the electron multiplier device, and the multiplied electrons are emitted from the corresponding apertures.

A smaller number of electrons generated in the vicinity of the incident light beam aperture can be trapped by acceleration electrode layer 6 of the first leaf in the electron multiplier device before the secondary electrons arrive at electron emission layer 5 in the next stage.

Most electrons, however, arrive at electron emission layer 5 in the next stage and are multiplied there.

If smaller number of electrons are trapped by acceleration electrode layer 6 of the first leaf in the electron multiplier device, it causes no problem. Unless the acceleration electrode layer 6 is provided, a small number of electrons touch the wall of each through-hole, and electrons on the wall of each through-hole can distort the electric field in the vicinity of the wall. Thus, a small number of electrons are trapped by acceleration electrode layer 6 of the first leaf in the electron multiplier device when the acceleration electrode layer is provided, but however, the electron multiplier device can be operated stably.

Figure 6:
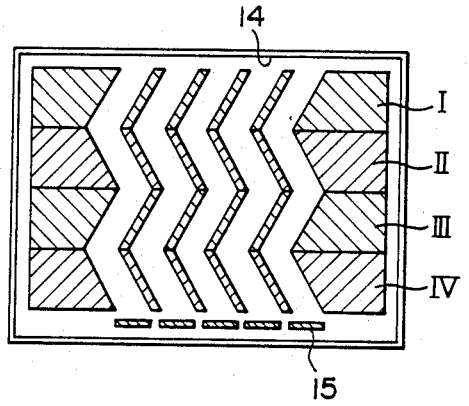
FIG. 6 is a cross-sectional view of an embodiment of the photomultiplier tube consisting of the first type of the electron multiplier device using four electron multiplier elements in a vacuum envelope.

FIG. 6 is a cross-sectional view of an embodiment of the photomultiplier tube wherein the electron multiplier device of the first type is provided within a vacuum envelope.

Photocathode 14 is formed on the inner surface of the incident window of vacuum envelope 9.

Anode 15 is provided corresponding to the emission aperture of the fourth leaf in the electron multiplier device.

Power supplies are connected to the respective leaves of dinodes in the electron multiplier device, and the highest DC voltage is applied to anode 15.

Figure 7:
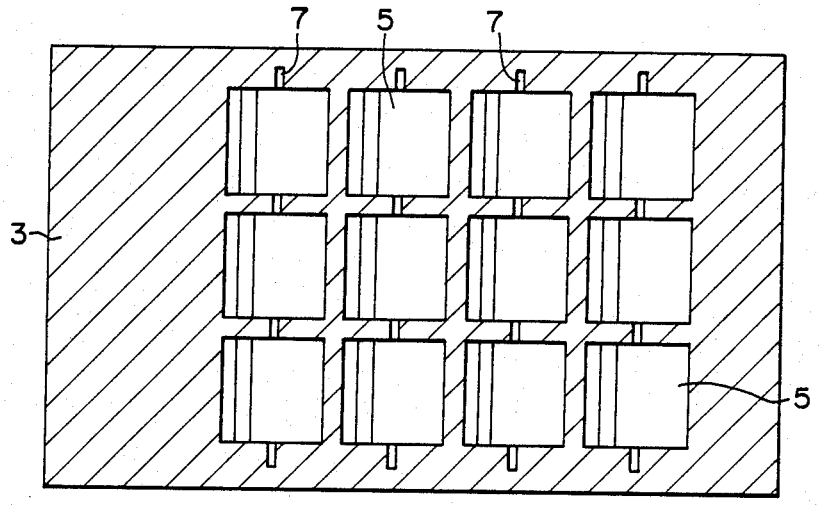
FIG. 7 is a plan view of the second embodiment of the first type of the electron multiplier device in accordance with the present invention using one electron multiplier element.

FIG. 7 is a plan view of a second embodiment of a electron multiplier device of the first type in accordance with the invention using one electron multiplier element. In the second embodiment, the aperture of through-hole 2 is square in structure. Thus, the mask pattern is simplified and the area of the aperture for the incident electrons is larger than that in the first embodiment.

Figure 8:
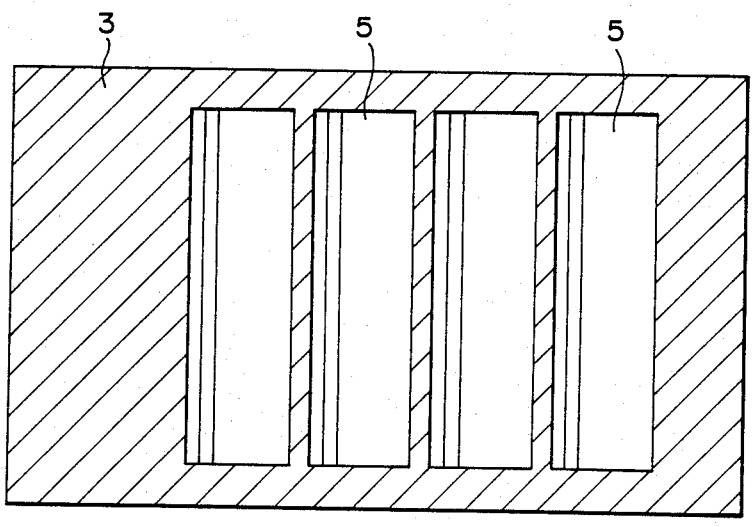
FIG. 8 is a plan view of the third embodiment of the first type of the electron multiplier device built in accordance with the present invention using one electron multiplier element.

FIG. 8 is a plan view of a third embodiment of a electron multiplier device of the first type accordance with the the invention, using one electron multiplier element.

The aperture of through-hole 2 in the third embodiment is rectangular in structure.

No two-dimensional information can be obtained by the electron multiplier device of this structure, but high sensitivity is assured.

Figure 9:
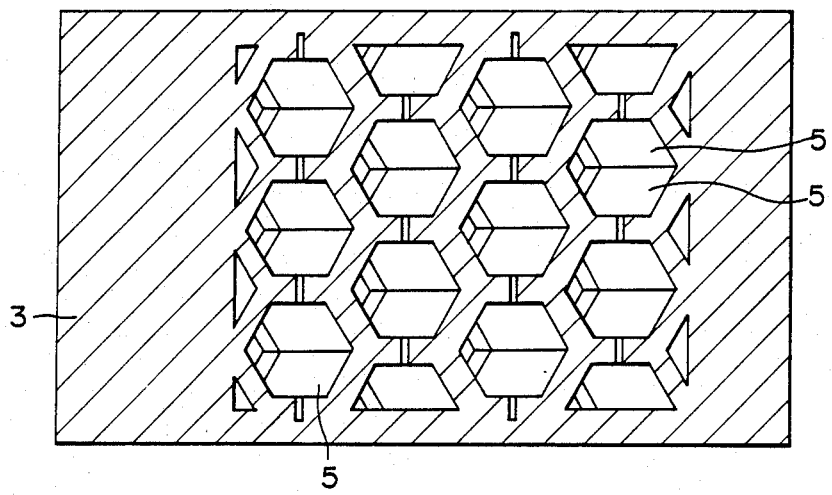
FIG. 9 is a plan view of the fourth embodiment of the first type of the electron multiplier device built in accordance with the present invention using one electron multiplier element.

FIG. 9 is a plan view of the fourth embodiment of a electron multiplier device of the first type in accordance with the invention, using one electron multiplier element.

The aperture of through-hole 2 in the fourth embodiment is hexagonal in structure.

No two-dimensional information can be obtained by the electron multiplier device of this structure, but high sensitivity is assured.

Figure 10:
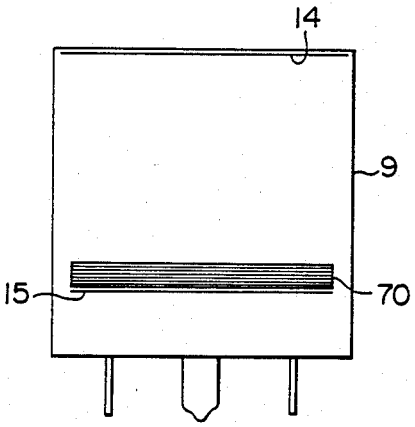
FIG. 10 is a cross-sectional view of another embodiment of the photomultiplier tube consisting of the first type of the electron multiplier device built in a vacuum envelope.

FIG. 10 is a cross-sectional view of another embodiment of the photomultiplier tube with an electron multiplier device in accordance with the first type of the present invention, using one electron multiplier element.

Photocathode 14 within vacuum envelope 9 is arranged against the first plane (incident plane) of the front leaf of a dinode in the electron multiplier device 70. The output signal is multiplied with a plurality of leaves of dinodes in the electron multiplier device. Element 15 is the anode.

Figure 11:
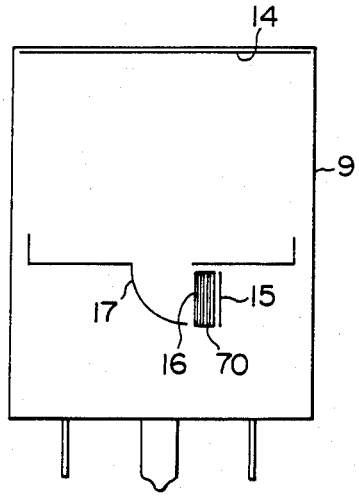
FIG. 11 shows a cross-sectional view of a further embodiment of the photomultiplier tube consisting of the first type of the electron multiplier device in a vacuum envelope.

FIG. 11 is a cross-sectional view of a further embodiment of the photomultiplier tube wherein an electron multiplier device of the first type of this invention is used.

The device in the embodiment shown in FIG. 11 consists of a plurality of dinodes 70 of the conventional box type. Incident aperture 16 of the photomultiplier tube is fastened to a dinode of box type. Anode 15 is used to trap electrons multiplied by the electron multiplier device.

The second type of electron multiplier device according to the present invention will be described hereinafter referring to FIGS. 12 through 16.

Figure 12:
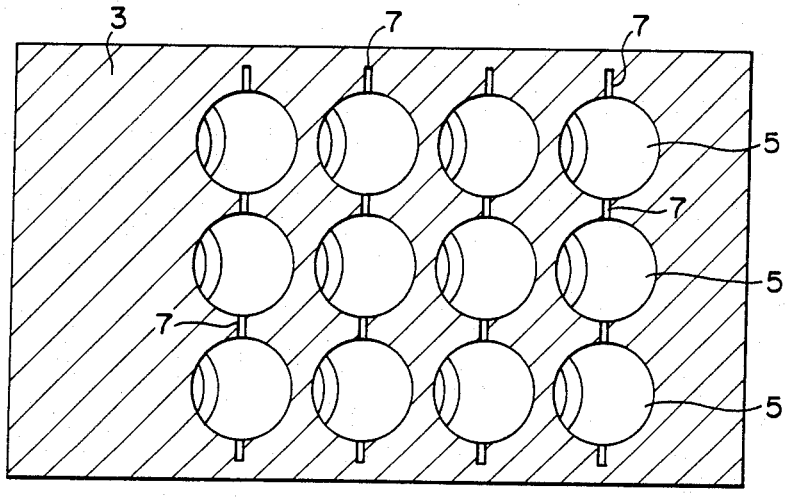
FIG. 12 is a plan view of the first embodiment of the second type of the electron multiplier device built in accordance with the present invention using one electron multiplier element.
Figure 13:
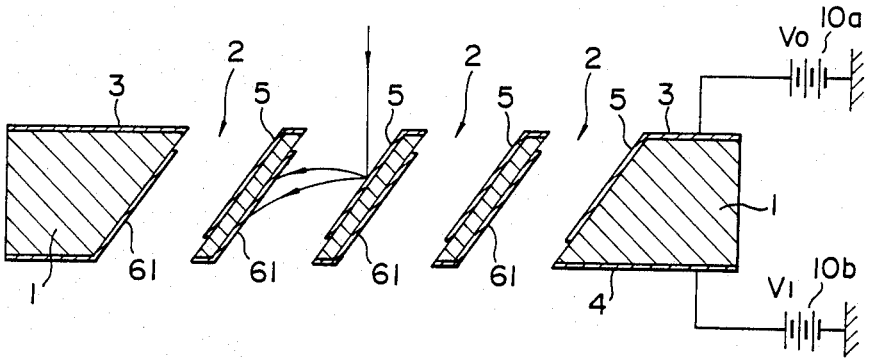
FIG. 13 is a cross-sectional view of the first embodiment of electron multiplier device according to the second type of the present invention shown in FIG. 12.
Figure 14:
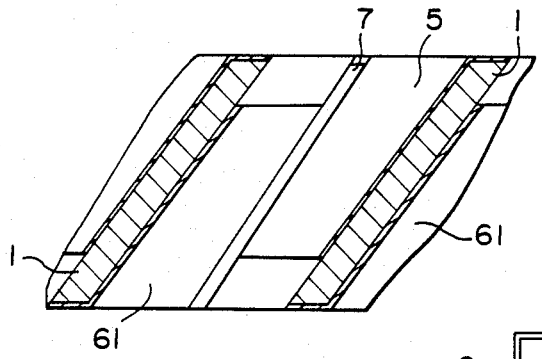
FIG. 14 is an enlarged view of a part of FIG. 13.

FIG. 12 is a plan view of a first embodiment of the electron multiplier device of the second type in accordance with the invention. FIG. 13 is a cross-sectional view of the embodiment shown in FIG. 12 in use. FIG. 14 is an enlarged view of a part of the first embodiment shown in FIG. 13.

A plurality of through-holes 2 with circular apertures are bored on a planar insulating substrate 1 made of glass ($SiO_2$), and these are inclined to the incident plane of the electron beam.

Through-holes 2 are bored by a photoetching process.

When insulating substrate 1 is exposed to the UV rays at an angle of the inclination through a negative image mask whereon a pattern consisting of the apertures and separation grooves are formed, a latent image is formed on the glass plate constituting insulating substrate 1, corresponding to the pattern of through-holes.

Thereafter, specific portions defined by the latent image are crystalyzed by heat treatment. Crystalyzed portions are selectively etched by acid to obtain a pattern of through-holes corresponding to the latent image pattern.

Antimony (Sb) is evaporated onto a first inclined plane of each through-hole, which is at an obtuse angle with respect to an upper surface of the substrate 1 whereon through-holes 2 are bored to form a first secondary electron emission layer 5 on this inclined plane. A second inclined plane of each through-hole 2 at an obtuse angle with respect to the lower surface of the substrate 1 whereon through-holes 2 are bored, and is separated from the first secondary electron emission layer by separation groove 7. Then, a second secondary electron emission layer 61 is formed onto this inclined plane by antimony evaporation.

The second secondary electron emission layer 61 is insulated from the upper surface of substrate 1 so that the first secondary electron emission layer 61 cannot extend to the aperture in this side of the through-hole.

Connection means 3 to connect a plurality of secondary electron emission layers 5 to the respective power supplies are formed on the first (upper) surface of insulating substrate 1 and connection means 4 to connect a plurality of second secondary electron emission layers 61 to the respective power supplies are formed on the second (lower) surface of insulating substrate 1.

The function of the electron multiplier device the second type in accordance with the present invention will be described referring to FIG. 13.

The electron multiplier device built in accordance with the respect invention is arranged within a vacuum envelope. Connection means 3 and 4 are connected to power supplies 10*a* and 10*b*, respectively. DC voltage $V_2$ fed from power supply 10*b* is greater DC voltage $V_1$ fed from power supply 10*a*.

The potential difference between $V_1$ and $V_2$ causes an acceleration field toward second secondary electron emission layer 61 starting from the first secondary electron emission layer 5.

Secondary electrons emitted from the first surface in the electron multiplier device is incident on secondary electron emission layer 5.

Secondary electrons generated from the above electrons are incident on second secondary electron emission layer 61 and then secondary electrons are thus emitted.

Figure 15:
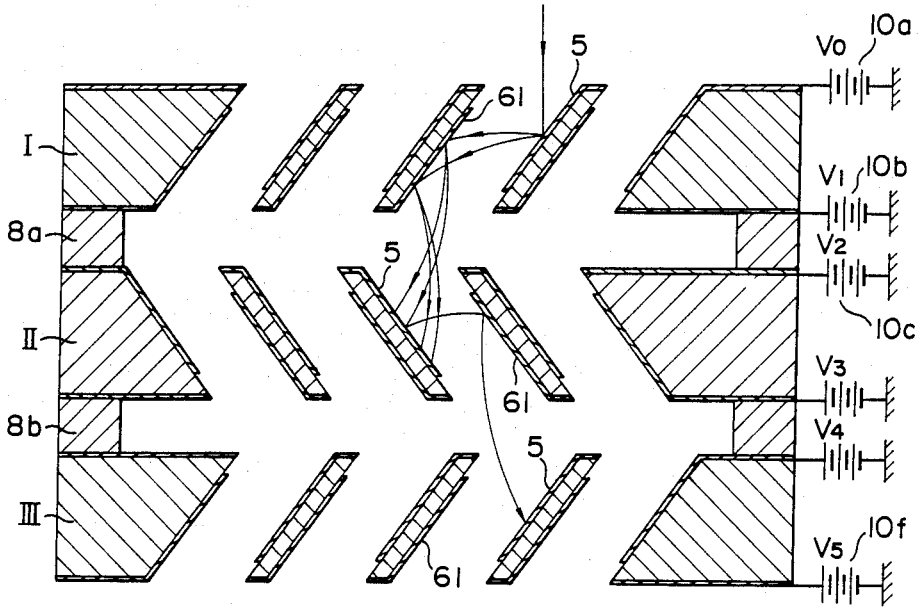
FIG. 15 is a cross-sectional view of an embodiment of the electron multiplier device consisting of three electron multiplier elements according to the second type of device of the present invention.

FIG. 15 is a cross-sectional view of an embodiment of the second type of the electron multiplier device in accordance with the present invention consisting of three leaves of dinodes.

The first leaf in the electron multiplier device is fastened to the second leaf in the electron multiplier device through insulating spacer 8*a*, so that the through-holes in the second leaf are inclined in the opposite direction to the through-holes in the first leaf.

The second leaf in the electron multiplier device is fastened to the third leaf in the electron multiplier device through insulating spacer 8*b*, so that the through-holes in the third leaf are inclined in the opposite direction to the through-holes in the second leaf and in the same direction as the through-holes in the first leaf. Power supplies 10*a* through 10*f* ($V_5>V_4>V_3>V_2>V_1>Vo$) are connected to the respective terminals of the electron multiplier device.

Figure 16:
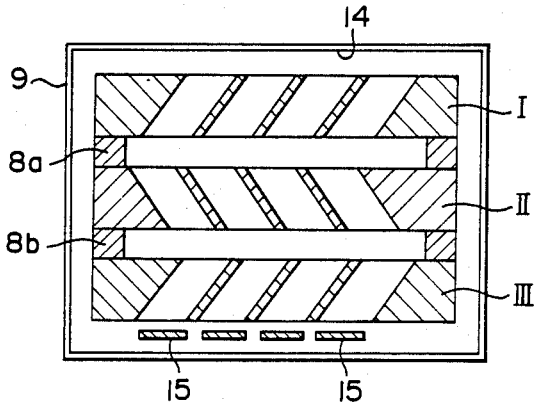
FIG. 16 is a cross-sectional view of an embodiment of the photomultiplier tube consisting of the electron multiplier device using three electron multiplier elements in a vacuum envelope according to the second type of device of the present invention.

FIG. 16 is a cross-sectional view of an embodiment of the photomultiplier tube wherein the electron multiplier device of the second type in accordance with the present invention is provided within a vacuum envelope.

Photocathode 14 is formed on the inner surface of the incident window of vacuum envelope 9.

Anode 15 is provided corresponding to the emission aperture of the third leaf in the electron multiplier device.

Power supplies are connected to the respective leaves of dinodes in the electron multiplier device, and the highest DC voltage is applied to anode 15.

A plan view of the second embodiment of an electron multiplier device of with the second type the present invention appears identical with FIG. 7. In this second embodiment, the aperture of through-hole 2 is square in structure. Holes on the insulating substrate can be finished in the same manner as described above with respect to in the first embodiment.

A plan view of the third embodiment of an electron multiplier device with the second type in accordance with the invention appears identical with FIG. 8.

As shown in FIG. 8, the aperture of through-hole 2 in the third embodiment is rectangular in structure.

No two-dimensional information can be obtained by the electron multiplier device of this structure, but high sensitivity is assured.

A plan view of the fourth embodiment of the electron multiplier device of the second type in accordance with the present invention appears identical to FIG. 9.

The aperture of through-hole 2 in the fourth embodiment in hexagonal in structure.

A cross-sectional view of another embodiment of a photomultiplier tube built a the electron multiplier device in accordance with the second type of the present invention appears just as in FIG. 11.

The device in this embodiment consists of a plurality of dinodes 70 of the conventional box type. Incident aperture 16 of the photomultiplier tube is fastened to a dinode of the box type. Anode 15 is used to trap electrons multiplied by the electron multiplier device.

As described heretofore, the element of the electron multiplier device of the first type accordance with present invention consists of an insulating substrate with the first and second (upper and lower) surfaces which are parallel with each other, a plurality of through-holes on the substrate where first surfaces of the through-holes are at an obtuse angle with respect to the first surface of substrate and second surfaces of the through-holes against the first surfaces of the through-holes, a secondary electron emission layer formed on the first surface of each through-hole by depositing active materials onto the first surface of the substrate, a conductive layer formed on the second surface of each through-hole which is separated from the secondary electron emission layer, first connection means to connect the secondary electron emission layer to the respective power supplies through the first surface of the substrate, second connection means to connect the conductive layer to the respective power supply through the second surface of the substrate, and means to multiply the electrons incident on the through-holes passing through the first surface of the substrate by using the secondary electron emission layer, and to apply a pair of DC voltages to the first and second connection means so that the multiplied electrons are accelerated toward the second surface of the substrate.

Such an electron multiplier device in accordance with the present invention is composed of the above-mentioned elements, and thus the electron multiplier device can be made compact.

For a small electron multiplier device, the electron transit time and its variation can be reduced. This makes an electron multiplier device with high time-resolution possible.

As described above, various types of photomultiplier tubes can be made with this type of electron multiplier device.

These photomultipliers can be used for measuring instruments in many fields because they are excellent in dimensional resolution and time resolution.

The normal electron multiplication factor (ratio of the number of output electrons to that of incident electrons) in the electron multiplier device of $10^8$ can be obtained by ten leaves of dinodes in the electron multiplier device.

The leaf of each dinode in the electron multiplier device is 0.5 mm thick, and thus the electron multiplier device can be made with a thickness of 5 mm or so.

The thickness of 5 mm is ⅛ of the thickness for the conventional electron multiplier device.

As also described hereintofore, the element of the electron multiplier device of the second type in accordance with the present invention consists of an insulating substrate with the first and second (upper and lower) surfaces which are parallel with each other, a plurality of through-holes on the substrate where first surfaces of the through-holes are at an obtuse angle with respect to the substrate and second surfaces of the through-holes against the first surfaces of the through-holes, a first secondary electron emission layer formed on the first surface of each through-hole, a second secondary electron emission layer formed on the second surface of each through-hole which is separated from the secondary electron emission layer, first connection means to connect the secondary electron emission layer to the respective power supplies through the first surface of the substrate, second connection means to connect the second secondary electron emission layer to the respective power supplies through the second surface of the substrate, and means to multiply the electrons incident on the through-holes passing through the first surface of the substrate by using the secondary electron emission layer, and to apply a pair of DC voltages to the first and second connection means so that the multiplied electrons are accelerated toward the second surface of the substrate.

Hence, secondary electrons are emitted twice from the incident electrons in a single electron multiplier device. The through-holes on the substrate, providing the electron multiplication function are arranged regularly, and they can be used as an incident electron position detection device.

As described above, a number of electron multiplier devices are connected in series to obtain a high electron multiplication factor.

The normal electron multiplication factor (ratio of the number of output electrons to that of incident electrons) in the electron multiplier device of $10^8$ can be obtained by five leaves of dinodes in this electron multiplier device.

The leaf of dinode in the electron multiplier device is 0.5 mm thick, and thus the electron multiplier device including the anode can be made with a thickness of 4 mm or so because the insulating space is 0.25 to 0.35 mm thick.

The thickness of 4 mm is 1/10 of the thickness for the conventional electron multiplier device.

The electron multiplier device of the second type in accordance with the present invention is composed of the above-mentioned elements, and thus the electron multiplier can be made compact. For a small electron multiplier device, the electron transit time and its variation can be reduced.

This makes an electron multiplier device with high time-resolution possible.

As described above, various types of photomultiplier tubes can be made with this type of electron multiplier device.

Thes photomultipliers can be used for measuring instruments in many fields because they are excellent in dimensional resolution and time resolution.

What is claimed is:

1. An electron multiplier device comprising:

an insulating substrate having opposite first and second substrate surfaces which are parallel with each other, a plurality of through-holes in said substrate having first through-hole surfaces at an obtuse angle with respect to said first substrate surfaces and second through-hole surfaces opposing said first through-hole surfaces, a secondary electron emission layer formed on said first through-hole surfaces, a conductive layer formed on of non-electron emissive materials the second through-hole surface of each respective through-hole separated from the secondary electron emission layer of the respective through-hole, first connection means to connect said secondary electron emission layer of each through-hole to a respective first DC voltage supply through said first substrate surface, and second connection means to connect said conductive layer of each through-hole to a respective second DC voltage supply through said second substrate surface, whereby electrons incident on said through-holes passing through said first substrate surface and impinging on said secondary electron emission layer are multiplied and accelerated toward the second substrate surface when the DC voltage of the first and second DC voltage supplies are respectively connected by said first and second connection means to said secondary emission layer and said conductive layer of each through-hole and the DC voltage of the second DC voltage supply is greater than the DC voltage of the first DC voltage supply.

2. An electron multiplier device as claimed in claim (1), wherein each through-hole is one of circular, rectangular, and hexagonal in said first substrate surface and the through-holes are closely and regularly arranged.

3. An electron multiplier device as claimed in claim 1, wherein said insulating substrate is made of $SiO_2$ and said through-holes are formed by photoetching.

4. An electron multiplier device as claimed in claim 1, wherein said substrate has a groove formed between and insulating from each other said secondary electron emission layer and said conductive layer in each through-hole.

5. An electron multiplier as in claim 1, further comprising first and second DC voltage supplies respectively connected by said first and second connecting means to said secondary electron emission layer and said conductive layer, and the DC voltage of the second DC voltage source is greater than the DC voltage of the first DC voltage source.

6. An electron multiplier device, comprising:

a plurality of successively adjacent dinode leaves successively layered on each other, including an upper first leaf and a second leaf, one directly adjacent the other, each of said plurality of leaves including an insulating substrate having opposite first and second substrate surfaces which are parallel with each other, a plurality of through-holes in said substrate, each of said through-holes being inclined to said first and second substrate surfaces and having a first through-hole surface intersecting said first substrate surface at an obtuse angle and a second through-hole surface opposing said first through-hole surface and intersecting said second substrate surface at an obtuse angle, a secondary electron emission layer formed on said first through-hole surfaces, a conductive layer of non-electron emissive materials formed on the second through-hole surface of each respective through-hole separated from the secondary electron emission layer of the respective through-hole, first connection means to connect said secondary electron emission layer of each through-hole to a respective first DC voltage supply associated with the respective leaf, through said first substrate surface, and second connection means to connect said conductive layer of each through-hole to a respective second DC voltage supply associated with the respective leaf, through said second substrate surface, the second connection means of said first leaf being electrically connected to the first connection means of said second leaf so that the conductive layer of each through-hole of said first leaf is at the same electrical potential as the electron emission layer of each through-hole of said second leaf;

the respective through-holes of each leaf being aligned with a respective one of the through-holes in each leaf adjacent thereto, the aligned through-holes of adjacent leaves being inclined in opposite directions;

whereby electrons incident on each through-hole of said first leaf passing through the first substrate surface thereof and impinging on said secondary electron emission layer are multiplied and accelerated toward the second substrate surface of said first leaf when the first and second DC voltage supplies associated with said first leaf are respectively connected by said first and second connection means to said secondary electron emission layer and said conductive layer of each through-hole and the DC voltage of the second DC voltage supply is greater than the DC voltage of the first DC voltage supply, the electrons accelerated toward the second substrate surface of said first leaf being incident of the through-hole of said second leaf and impinging on the secondary electron emission layer thereof and being further multiplied and accelerated toward the second substrate surface of said second leaf when the first and second DC voltage supplies associated with said second leaf are respectively connected to said first and second connection means of said second leaf to said secondary electron emission layer of said second leaf and said conductive layer of each through-hole of said second leaf, and the DC voltage of the second DC voltage supply associated with said second leaf is greater than the DC voltage of the first DC voltage supply associated with said second leaf, the DC voltage of the second DC voltage supply associated with said first leaf being equal to the DC voltage of the first DC voltage supply associated with said second leaf.

7. An electron multiplier device as in claim 6, wherein said substrate of each of said leaves has a groove formed between and insulating from each other said secondary electron emission layer and said conductive layer in each through-hole.

8. An electron multiplier device as in claim 6, further comprising a first leaf first DC voltage supply connected by said first connecting means of said first leaf to said secondary electron emission layer of said first leaf, a first leaf second DC voltage supply connected by said second connecting means of said first leaf to said conductive layer of said first leaf and by said secondary electron emission layer of said second leaf to said secondary electron emission layer of said second leaf, and a second leaf DC voltage supply connected by said second connecting means of said second leaf to said conductive layer of said second leaf, the DC voltage of said first leaf first voltage supply being less than the DC voltage of said second leaf voltage source.

9. An electron multiplier device as in claim 8, wherein said substrate of each of said leaves has a groove formed between and insulating from each other said secondary electron emission layer and said conductive layer in each through-hole.

10. An electron multiplier device as in claim 6, wherein the first connecting means and second connecting means of each leaf are respectively formed on the first substrate surface and second substrate surface thereof, so as to respectively make direct physical and electrical contact with the second connecting means and first connecting means of respective ones of said leaves directly adjacent thereto.

11. An electron multiplier device as in claim 6, wherein said conductive layer is formed of inactive conductive materials.

* * * * *